US010132160B2

(12) United States Patent
Roberson et al.

(10) Patent No.: US 10,132,160 B2
(45) Date of Patent: Nov. 20, 2018

(54) DOWNHOLE WIRELESS COMMUNICATIONS USING SURFACE WAVES

(71) Applicant: Halliburton Energy Services, Inc., Houston, TX (US)

(72) Inventors: Mark W. Roberson, Cary, NC (US); Paul F. Rodney, Spring, TX (US); Scott Goodwin, Chapel Hill, NC (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/541,823

(22) PCT Filed: Mar. 11, 2015

(86) PCT No.: PCT/US2015/019862
§ 371 (c)(1),
(2) Date: Jul. 6, 2017

(87) PCT Pub. No.: WO2016/144347
PCT Pub. Date: Sep. 15, 2016

(65) Prior Publication Data

US 2018/0003040 A1 Jan. 4, 2018

(51) Int. Cl.

| | |
|---|---|
| ***E21B 47/12*** | (2012.01) |
| *E21B 47/06* | (2012.01) |
| *E21B 47/10* | (2012.01) |

(52) U.S. Cl.
CPC ..... *E21B 47/122* (2013.01); *E21B 47/06* (2013.01); *E21B 47/065* (2013.01); *E21B 47/10* (2013.01)

(58) Field of Classification Search
CPC ..... E21B 47/06; E21B 47/065; E21B 47/10; E21B 47/122
(Continued)

(56) References Cited

U.S. PATENT DOCUMENTS

| | | | |
|---|---|---|---|
| 4,390,975 | A | 6/1983 | Shawhan |
| 5,148,408 | A | 9/1992 | Matthews |

(Continued)

FOREIGN PATENT DOCUMENTS

| | | |
|---|---|---|
| WO | 2014100272 | 6/2014 |

OTHER PUBLICATIONS

"Surface Waves", retrieved from the internet at http://en.wikipedia.org/wiki/Surface_wave, at least as early as Mar. 16, 2015.

(Continued)

*Primary Examiner* — Hirdepal Singh
(74) *Attorney, Agent, or Firm* — Kilpatrick Townsend & Stockton LLP

(57) ABSTRACT

A communication system that is positionable in a wellbore can include a first transceiver for coupling externally to a casing string. The first transceiver can be for wirelessly transmitting data by generating and modulating a surface wave that propagates along an interface surface. The surface wave can include an electromagnetic wave that has a magnetic field or an electric field that is at an acute angle to a direction of propagation of the surface wave. The communication system can also include a second transceiver for coupling to the casing string and for wirelessly receiving the surface wave and detecting the data.

20 Claims, 5 Drawing Sheets

(58) Field of Classification Search
USPC ..... 340/854.6
See application file for complete search history.

(56) References Cited

U.S. PATENT DOCUMENTS

2003/0098157 A1* 5/2003 Hales ..... E21B 43/1185 166/297
2005/0263286 A1* 12/2005 Sheffield ..... E21B 43/117 166/297
2006/0290529 A1* 12/2006 Flanagan ..... G01V 11/002 340/854.6
2008/0030365 A1 2/2008 Fripp et al.
2010/0177596 A1 7/2010 Fink et al.
2010/0223988 A1 9/2010 Crow et al.
2011/0298461 A1* 12/2011 Bittar ..... G01V 3/28 324/338
2012/0194399 A1* 8/2012 Bily ..... H01Q 13/28 343/772
2014/0246237 A1 9/2014 Prammer
2015/0354351 A1* 12/2015 Morrow ..... E21B 47/01 367/82
2015/0377016 A1* 12/2015 Ahmad ..... E21B 47/16 340/855.8
2018/0003035 A1* 1/2018 Luht ..... E21B 41/0085
2018/0059274 A1* 3/2018 Coates ..... G01V 1/36
2018/0123641 A1* 5/2018 Fuchs ..... H04B 3/56

OTHER PUBLICATIONS

Barlow et al., "Surface Waves", IEEE Radio Section, Paper No. 1482, Apr. 22, 1953, pp. 329-341.
International Patent Application No. PCT/US2015/019862 , "International Search Report and Written Opinion", dated Oct. 16, 2015, 14 pages.
Sommerfeld , "Über die Fortpflanzung elektrodynamischer Wellen an längs eines Drahtes", Über die Fortpflanzung elektrodynamischer Wellen an längs eines Drahtes, Ann. der Physik und Chemie, vol. 67 (English Translation of title: Propagation of electro-dynamic waves along a cylindric conductor), Dec. 1899, pp. 233-290 (As noted in the accompanying Transmittal Letter, no English translation is available to the Applicant).
Zenneck , "Über die Fortpflanzung ebener elektromagnetischer Wellen längs einer ebenen Leiterfläche und ihre Beziehung zur drahtlosen Telegraphie", Ann. der Physik, vol. 23 (English Translation of title: "About the propagation of electromagnetic plane waves along a conductor plane and their relationship to wireless telegraphy" ), Sep. 1907, pp. 846-866 ( As noted in the accompanying Transmittal Letter, no English translation is available to the Applicant).

* cited by examiner

DOWNHOLE WIRELESS COMMUNICATIONS USING SURFACE WAVES

CROSS-REFERENCE TO RELATED APPLICATIONS

This is a U.S. national phase under 35 U.S.C. 371 of International Patent Application No. PCT/US2015/019862 titled "Downhole Wireless Communication Using Surface Waves" and filed Mar. 11, 2015, the entirety of which is incorporated herein by reference.

TECHNICAL FIELD

The present disclosure relates generally to devices for use in well systems. More specifically, but not by way of limitation, this disclosure relates to downhole wireless communication using surface waves.

BACKGROUND

A well system (e.g., an oil or gas well for extracting fluid or gas from a subterranean formation) can include various sensors. For example, a well system can include sensors for measuring well system parameters, such as temperature, pressure, resistivity, or sound levels. In some examples, the sensors can transmit data via cables to a well operator (e.g., typically at the surface of the well system). Cables can wear or fail, however, due to the harsh downhole environment or impacts with well tools. In other examples, the sensors can wirelessly transmit data to the well operator. The sensors can be positioned far away from the well surface, however, which can lead to attenuation and distortion of the wireless transmissions. It can be challenging to wirelessly communicate data from the sensors to the well surface efficiently.

DETAILED DESCRIPTION

Figure 1:
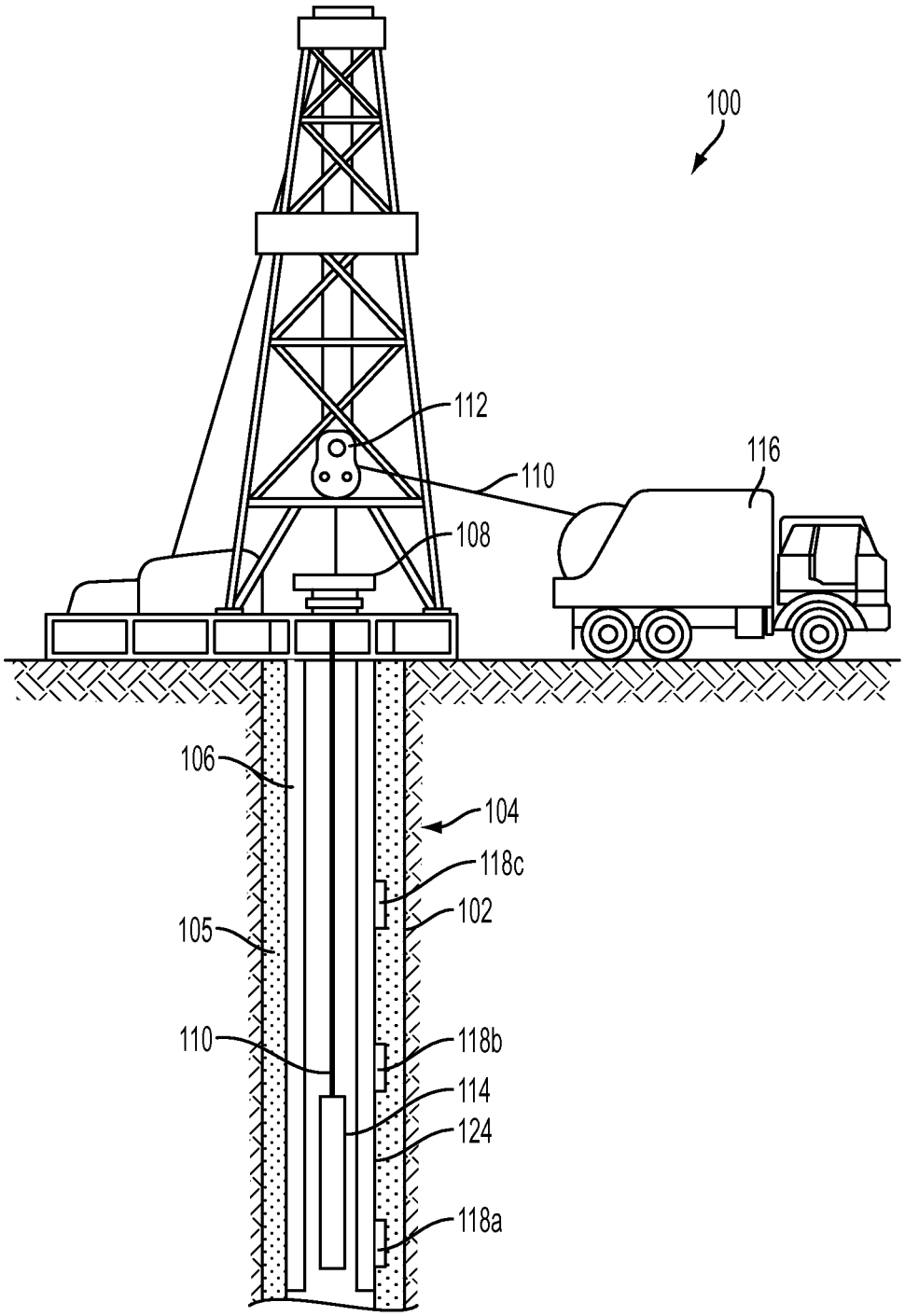
FIG. 1 is a cross-sectional view of an example of a well system that includes a system for downhole wireless communication using surface waves.

Certain aspects and features of the present disclosure are directed to downhole wireless communications using surface waves. The wireless communications can be between two transceivers positioned external to a casing string in a wellbore. A transceiver can be positioned external to the casing string if it is positioned on or outside of an outer diameter or outer wall of the casing string. Each transceiver can include an antenna (e.g., a solenoid, toroid antenna, or dipole) for wirelessly communicating with the other transceiver using surface waves.

A surface wave can include an electromagnetic wave that propagates along an interface surface between two different media (e.g., two different solids or fluids) and does not produce electromagnetic radiation. The surface wave can include an electric field, a magnetic field, or both that are not transverse (e.g., not perpendicular) to the direction of propagation. For example, the electric field, the magnetic field, or both can be oriented in the direction of propagation (e.g., parallel to the direction of propagation) of the electromagnetic wave. As another example, the electric field, the magnetic field, or both can be at an acute angle to the direction of propagation of the electromagnetic wave.

Surface waves can differ from other types of electromagnetic waves in multiple ways. For example, absorption of surface wave's energy can be strictly within the media through which the surface wave propagates. This absorption of energy can be very closely confined to a thin volume of material on either side of the interface surface. This is unlike other forms of electromagnetic waves, which may carry energy away from the media from which the electromagnetic waves originate or through which the electromagnetic waves propagate. For example, other forms of electromagnetic waves that propagate through, for example, a waveguide can leak energy through the waveguide and emit radiation into the media surrounding the waveguide.

The transceivers can wirelessly communicate data using surface waves. A transceiver can generate surface waves by transmitting power to an antenna at a frequency within a specific frequency range (e.g., between 1 kHz and 1 MHz). In one example, the specific frequency range can depend on the desired data communication rate. In another example, if repeaters are used to propagate the signal along a signal path, the specific frequency band can depend on a tradeoff between repeater latency and data transfer rate. In some examples, transmitting power to the antenna at a frequency outside of the specific frequency range can cause the antenna to generate inductive fields, rather than surface waves. In some examples, the surface waves can propagate along the interface surface between the casing string and a cement sheath positioned in the wellbore (e.g., coupling the casing string to the walls of the wellbore). The other transceiver can detect the surface waves (e.g., via its antenna) to receive the data.

In some examples, surface waves can travel farther distances with less attenuation than other methods of downhole wireless communication. For example, an inductive field transmitted into the subterranean formation of the wellbore can propagate through the subterranean formation to a receiving wireless communication device. But the inductive field can attenuate and distort based on the characteristics (e.g., the conductivity) of the subterranean formation, which may be impractical or infeasible to control. Surface waves can propagate along the interface surface between a cement sheath and a casing string in a wellbore, rather than through the subterranean formation. Because the cement sheath and the casing string are both man-made well components, it can be easier to control the characteristics (e.g., conductivity and geometry) of the interface surface. For example, the casing string can include a material (e.g., metal) and shape configured to improve or optimize surface wave propagation. This can allow wireless communications via surface waves to have improved power transmission efficiency over larger distances.

In one example, a wellbore can include a casing string coupled to the walls of the wellbore via a cement sheath (e.g., to prevent the walls of the wellbore from collapsing). A well tool can be positioned within the casing string. Transceivers can be positioned at various intervals along the casing string. The transceivers can include one or more sensors for detecting parameters associated with the well system. Examples of sensors can include a pressure sensor, a temperature sensor, a microphone, a resistivity sensor, a vibration sensor, a fluid flow sensor, or any combination of these. A transceiver may detect a well system parameter (e.g., temperature) and transmit a wireless communication associated with the well system parameter to another transceiver. To transmit the wireless communication, the transceiver can apply an electrical signal with a specific frequency to an antenna. The electrical signal can cause the antenna to generate surface waves, which can propagate along the interface surface between the casing string and the cement sheath. The other transceiver can detect the surface waves via an antenna to receive the wireless communication.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a well system 100 that includes a system for downhole wireless communication using surface waves. The well system 100 includes a wellbore 102 extending through various earth strata. The wellbore 102 extends through a hydrocarbon bearing subterranean formation 104. A casing string 106 extends from the surface 108 to the subterranean formation 104. The casing string 106 can provide a conduit through which formation fluids, such as production fluids produced from the subterranean formation 104, can travel from the wellbore 102 to the surface 108. The casing string 106 can be coupled to the walls of the wellbore 102 via cement. For example, a cement sheath 105 can be positioned (e.g., formed) between the casing string 106 and the walls of the wellbore 102 for coupling the casing string 106 to the wellbore 102.

The well system 100 can also include at least one well tool 114 (e.g., a formation-testing tool). The well tool 114 can be coupled to a wireline 110, slickline, or coiled tube that can be deployed into the wellbore 102. The wireline 110, slickline, or coiled tube can be guided into the wellbore 102 using, for example, a guide 112 or winch. In some examples, the wireline 110, slickline, or coiled tube can be wound around a reel 116.

The well system 100 can include transceivers 118*a-c* that can wirelessly communicate. In some examples, each of the transceivers 118*a-c* can be positioned on, partially embedded within, or fully embedded within the casing string 106, the cement sheath 105, or both. In some examples, the transceivers 118*a-c* can be positioned externally to the casing string 106. For example, the transceivers 118*a-c* can be positioned on an outer housing of the casing string 106, within the cement sheath 105, or within the subterranean formation 104. Positioning the transceivers 118*a-c* externally to the casing string 106 can be advantageous over positioning the transceivers 118*a-c* elsewhere in the well system 100, such as within the casing string 106, which can affect an internal drift diameter of the casing string 106. Additionally, positioning the transceivers 118*a-c* externally to the casing string 106 can allow the transceivers 118*a-c* to more accurately and efficiently detect characteristics of the subterranean formation 104, the cement sheath 105, and the casing string 106.

The transceivers 118*a-c* can each include an antenna (not shown). Each of the transceivers 118*a-c* can use an antenna to transmit data and receive data. For example, a transceiver 118*a* can apply power to an antenna at a frequency within a specific frequency range (e.g., 1 kHz to 1 MHz). This can cause the antenna to generate a surface wave that can propagate along an interface surface 124 between the cement sheath 105 and the casing string 106. Another transceiver 118*b* can detect the presence of the surface wave via an antenna and receive the data represented by the surface wave. In this manner, the transceivers 118*a-c* can wirelessly communicate using surface waves.

In some examples, the transceivers 118*a-c* can receive data and relay the data (or associated data) to other electronic devices. For example, a transceiver 118*a* can transmit data to another transceiver 118*b* (e.g., positioned farther uphole), which can relay the data to still another transceiver 118*c* (e.g., positioned even farther uphole), and so on, all using surface waves. In this manner, data can be wirelessly communicated in segments or "hops" to a destination (e.g., uphole or downhole). As another example, one transceiver 118*b* can transmit data to another transceiver 118*c*, which can relay the data to a destination (e.g., the surface 108) via a wired interface (e.g., a wire positioned in the casing string 106 or the cement sheath 105).

Figure 2:
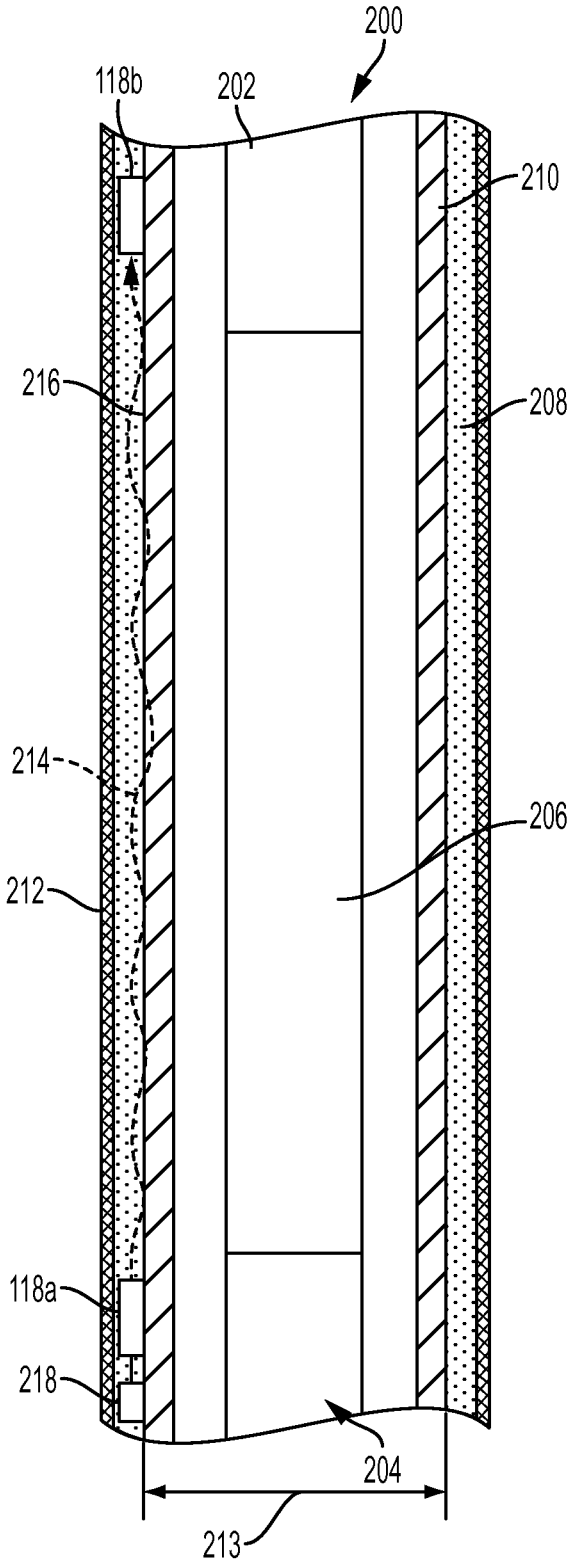
FIG. 2 is a cross-sectional side view of an example of part of a system for downhole wireless communication using surface waves that includes transceivers positioned partially within a cement sheath.

Transceivers according to various aspects can be located in various locations within the wellbore 102 and embedded in various components. For example, FIG. 2 is a cross-sectional side view of part of a system for downhole wireless communication using surface waves that includes transceivers 118*a*, 118*b* positioned partially within a cement sheath 208. In other examples, the transceivers 118*a*, 118*b* can be positioned partially within the casing string 210 and partially within cement sheath 208. In this example, the system includes a well tool 200 with three subsystems 202, 204, 206. The system also includes the cement sheath 208 to couple the casing string 210 to the subterranean formation 212.

The system includes the transceivers 118*a*, 118*b*. A transceiver 118*a* can transmit power to an antenna at a frequency within a specific frequency range for generating surface waves. In some examples, the specific frequency range can depend on the characteristics of the casing string 210. For example, the specific frequency range can depend on a diameter 213 of the casing string 210, the conductivity of the casing string 210, the magnetic permeability of the casing string 210, or any combination of these. The specific frequency range can also depend on characteristics of the cement sheath 208. For example, the specific frequency range can depend on the conductivity of the cement sheath 208, the dielectric constant of the cement sheath 208, the magnetic permeability of the cement sheath 208, or any combination of these. In one example, if the diameter of the casing string 210 is 196.85 millimeters and the cement sheath 208 has a conductivity of 1 semen/meter, the specific frequency range can be between 10 kHz and 700 kHz. Applying power to an antenna at a frequency within an specific frequency range can cause the transceiver 118*a* to generate a surface wave 214. The surface wave 214 can propagate along the interface surface 216 between the cement sheath 208 and the casing string 210.

More specifically, in some examples, assuming that the casing string 210 is cylindrical, and defining "z" as a z-axis that is an axis of symmetry of the casing string 210, a radial coordinate "r" as orthogonal to the z-axis, and a polar coordinate Θ, the surfaces waves 214 can propagate along the casing string 210 according to the following mathematical equations:

$$H_\theta = 2i * A * \left(\frac{\epsilon 1}{\pi * r\sigma * \mu_0 * \sigma_{eff}}\right) * e^{-\sqrt{\frac{\omega * \mu_0 * \sigma_{eff}}{2}}(1+i)*z} * \left(\frac{1}{r}\right)$$

$$E_z = \frac{2i}{\pi} * A * e^{-\sqrt{\frac{\omega * \mu_0 * \sigma_{eff}}{2}}(1+i)*z} * \left(\frac{3i * \pi}{4} + \mathrm{Ln}\left[r\sqrt{r\sigma}\sqrt{\omega\mu_0\sigma_{eff}}\right]\right)$$

$$E_r = -2 * A * \left(\frac{1}{\pi * r\sigma * \sqrt{\omega * \mu_0 * \sigma_{eff}}}\right) * e^{1*\frac{\pi}{4}} * e^{-\sqrt{\frac{\omega * \mu_0 * \sigma_{eff}}{2}}(1+i)*z} * \left(\frac{1}{r}\right)$$

where $H_\theta$ is the polar component of magnetic field intensity outside of the casing string 210; $E_z$ is the electric field component along the casing string 210; $E_r$ is the radial component of the electric field (e.g., orthogonal to the casing string 210); A is the source-dependent amplitude; $i=\sqrt{-1}$; $\in 1$ is the effective dielectric constant of the casing string 210; $\mu_0=4\pi(10^{-7})$ Henrys/meter, the permeability of free space;

$$\sigma_{eff} \equiv \frac{\sigma_1 * \sigma_2}{\sigma_1 + \sigma_2};$$

$$r\sigma \equiv \frac{\sigma_2}{\sigma_1};$$

$\sigma_1$ is the conductivity (in mhos/m) of the material within the casing string 210; $\sigma_2$ is the conductivity (in mhos/m) of the material outside of the casing string 210; and ω is equal to 2 πf, where f is the frequency in Hertz. In some examples, $\sigma_1 >> \sigma_2$ so that $\sigma_{eff} \sim \sigma_2$ and $r\sigma << 1$. In some examples, because $E_z$ is not vanishing, the electric field can be tilted with respect to a normal direction to the casing string 210.

The surface waves 214 can propagate along the z-axis according to the following mathematical equation:

$$e^{-\sqrt{\frac{\omega * \mu_0 * \sigma_{eff}}{2}} * z} * \left(\frac{1}{r}\right)$$

where $$\sqrt{\frac{\omega * \mu_0 * \sigma_{eff}}{2}}$$

is the reciprocal of the "skin depth" in the medium outside of the casing string 210. Because of this factor, in some examples, the frequency should be kept as low as possible while sustaining the required data rate.

In some examples, the transceivers 118*a-c* can generate surface waves 214 in which the z-axis component of electric field outside of the casing string 210 (which can be defined as $E_z$) and the radial component of electric field outside of the casing string 210 (which can be defined as $E_r$) are non-vanishing, and which has only a polar component of the magnetic field intensity (which can be defined as $H_e$). Such surface waves 214 can be generated using any type of antenna capable of producing an electric field parallel to the axis of the casing string 210. For example, the transceivers 118*a-c* can use an electric dipole antenna with a non-vanishing projection of the dipole moment along the z-axis of the casing string 210 or a toroid antenna, where the projection of the axis of the toroid onto the axis of the casing string is non-vanishing.

In some examples, the transceivers 118*a-c* can generate surface waves 214 in which the z-axis component of the magnetic field outside the casing string 210 (which can be defined as $H_z$) and the radial component of the magnetic field outside of the casing string 210 (which can be defined as $H_r$) are non-vanishing, and which has only a polar component of the electric field (which can be defined as $E_\theta$). Such surface waves 214 can be generated using any type of antenna capable of producing a magnetic field parallel to the axis of the casing string 210. For example, the transceivers 118*a-c* can use a magnetic dipole antenna with a non-vanishing projection of the dipole moment along the z-axis of the casing string 210.

The surface wave 214 can include an electric field, a magnetic field, or both that can be oriented at an acute angle to a direction of propagation of the surface wave 214 (e.g., the direction from 118*a* to 118*b*). An acute angle can include an angle that is less than 90 degrees (e.g., between 0 and 89 degrees). For example, the electric field, magnetic field, or both can be oriented at an angle of 50 degrees to a direction of propagation of the surface wave 214. As another example, the electric field, magnetic field, or both can be at an acute angle when oriented at an angle of 130 degrees (e.g., in the counter-clockwise direction from the direction of propagation), because a supplementary angle (e.g., in the clockwise direction from the direction of propagation) is 50 degrees. Another transceiver 118*b* can receive the surface wave 214, effectuating wireless communication.

In some examples, the surface wave 214 can include a Zenneck surface wave, a Sommerfeld surface wave, a radial-cylindrical surface wave, an axial-cylindrical surface wave, or any combination of these. The type of surface wave 214 can depend on the geometry of the interface between the casing string 210 and the cement sheath 208. For example, the cylindrical geometries of the casing string 210 and the cement sheath 208 can allow the transceivers 118*a*, 118*b* to generate Zenneck surface waves and Sommerfeld surface waves, or radial-cylindrical surface waves and axially-cylindrical surface waves, respectively.

The transceivers 118*a*, 118*b* can communicate data via surface waves 214 using a variety of techniques. In some examples, the presence or absence of the surface waves 214 can communicate data. For example, one transceiver 118*a* can communicate data to another transceiver 118*b* by pulsing surface waves 214 in a particular sequence. In other examples, the transceivers 118*a*, 118*b* can modulate characteristics (e.g., amplitude, frequency, and phase) of the surface wave 214 to communicate data.

In some examples, a transceiver 118*a*, 118*b* can include or be electrically coupled to a sensor 218. In the example shown in FIG. 2, the transceiver 118*a* is electrically coupled to a sensor 218 by a wire. Examples of the sensor 218 can include a pressure sensor, a temperature sensor, a microphone, a resistivity sensor, a vibration sensor, or a fluid flow sensor.

In some examples, the sensor 218 can transmit sensor signals to a processor (e.g., associated with a transceiver 118*a*). The sensor signals can be representative of sensor data. The processor can receive the sensor signals and cause the transceiver 118*a* to generate one or more surface waves associated with the sensor data. For example, the processor can transmit signals to an antenna to generate surface waves in a particular sequence representative of the sensor data. In other examples, the sensor 218 can additionally or alternatively transmit sensor signals to an electrical circuit. The electrical circuit can include operational amplifiers, integrated circuits, filters, frequency shifters, capacitors, inductors, and other electrical circuit components. The electrical circuit can receive the sensor signal and perform one or more functions (e.g., amplification, frequency shifting, and filtering) to cause the transceiver 118*a* to generate surface waves. For example, the electrical circuit can amplify and frequency shift the sensor signals into a specific frequency range for generating surface waves, and transmit the amplified and frequency-shifted signal to an antenna. This can cause the antenna to generate surface waves that are representative of the sensor signals.

Figure 3:
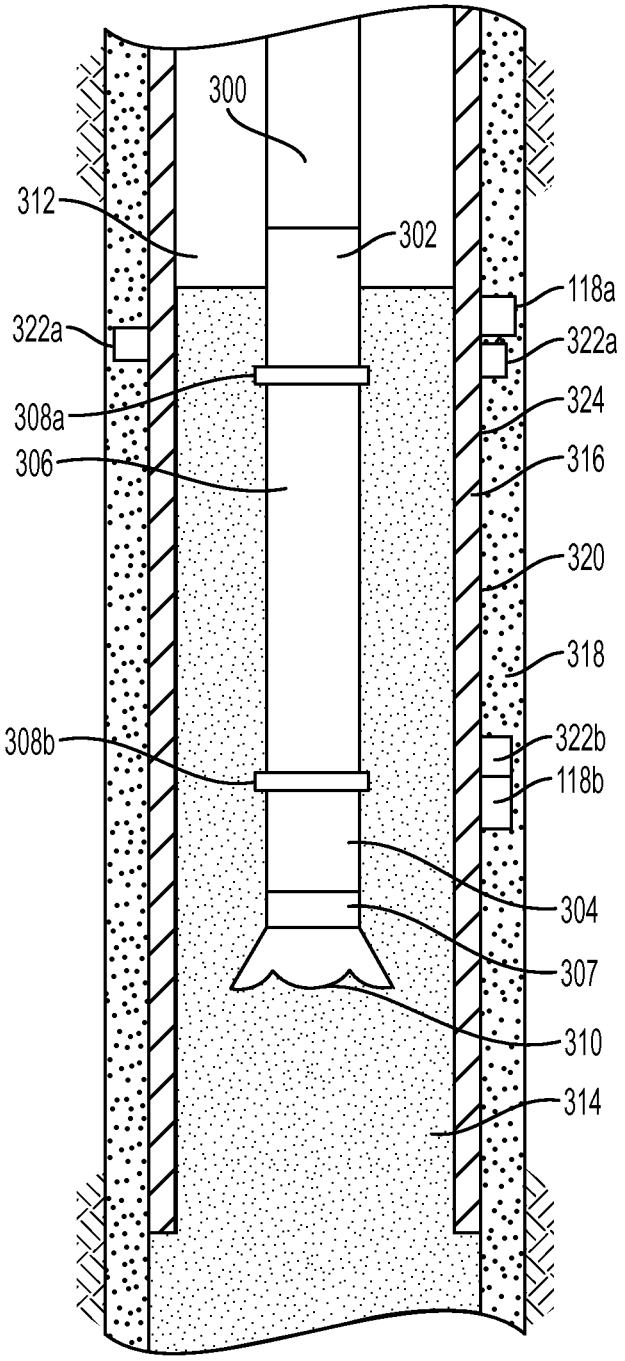
FIG. 3 is a cross-sectional side view of another example of a part of a well system that includes a system for downhole wireless communication using surface waves.

FIG. 3 is a cross-sectional side view of another example of a part of a well system that includes a system for downhole wireless communication using surface waves. In this example, the well system includes a wellbore. The wellbore can include a casing string 316 and a cement sheath 318. An interface surface 320 can couple the casing string 316 to the cement sheath 318. The wellbore can include fluid 314. The fluid 314 (e.g., mud) can flow in an annulus 312 positioned between the well tool 300 and a wall of the casing string 316.

A well tool 300 (e.g., logging-while-drilling tool) can be positioned in the wellbore. The well tool 300 can include various subsystems 302, 304, 306, 307. For example, the well tool 300 can include a subsystem 302 that includes a communication subsystem. The well tool 300 can also include a subsystem 304 that includes a saver subsystem or a rotary steerable system. A tubular section or an intermediate subsystem 306 (e.g., a mud motor or measuring-while-drilling module) can be positioned between the other subsystems 302, 304. In some examples, the well tool 300 can include a drill bit 310 for drilling the wellbore. The drill bit 310 can be coupled to another tubular section or intermediate subsystem 307 (e.g., a measuring-while-drilling module or a rotary steerable system).

The well tool 300 can also include tubular joints 308*a*, 308*b*. Tubular joint 308*a* can prevent a wire from passing between one subsystem 302 and the intermediate subsystem 306. Tubular joint 308*b* can prevent a wire from passing between the other subsystem 304 and the intermediate subsystem 306. The tubular joints 308*a*, 308*b* may make it challenging to communicate data through the well tool 300. It may be desirable to communicate data externally to the well tool 300, for example, using transceivers 118*a-b*.

In some examples, transceivers 118*a-b* can be positioned on the casing string 316. The transceivers 118*a-b* can allow for wireless communication of data using surface waves. Each transceiver 118*b* can include an antenna 322*b* (e.g., a toroid antenna, dipole antenna, or solenoid antenna). The antenna 322*b* can be positioned on the casing string 316. In some examples, an antenna 322*a* can be positioned coaxially around the casing string 316. For example, the antenna 322*a* can be electrically coupled to a transceiver 118*a* (e.g., by a wire extending through the casing string 316) and positioned coaxially around an outer housing 324 of the casing string 316. As discussed above, the transceivers 118*a-b* can wirelessly communicate by generating surface waves that propagate along the interface surface 320.

Figure 4:
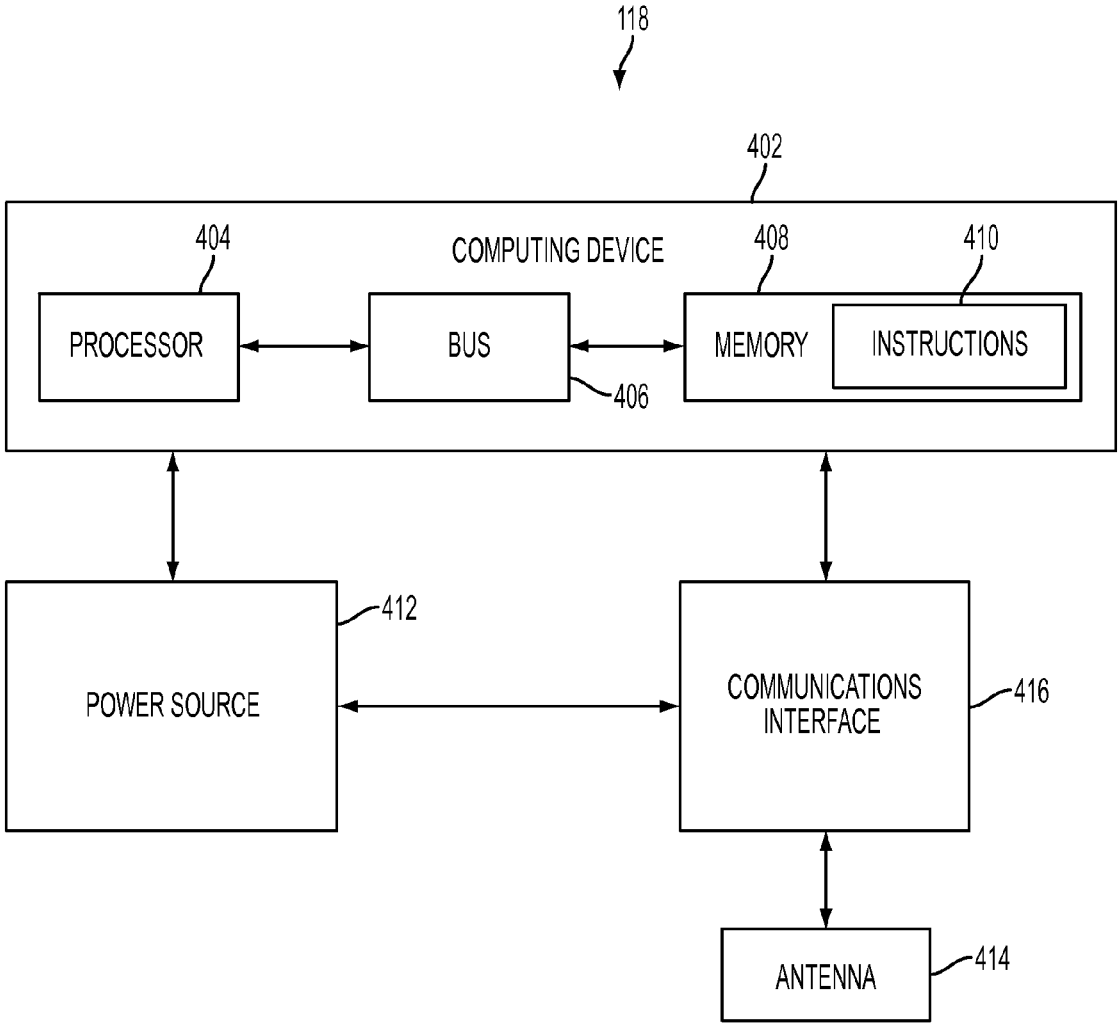
FIG. 4 is a block diagram of an example of a transceiver for implementing downhole wireless communications using surface waves.

FIG. 4 is a block diagram of an example of a transceiver 118 for implementing downhole wireless communications using surface waves. In some examples, the components shown in FIG. 4 (e.g., the computing device 402, power source 412, and communications interface 416) can be integrated into a single structure. For example, the components can be within a single housing. In other examples, the components shown in FIG. 4 can be distributed (e.g., in separate housings) and in electrical communication with each other.

The transceiver 118 can include a computing device 402. The computing device 402 can include a processor 404, a memory 408, and a bus 406. The processor 404 can execute one or more operations for operating a transceiver. The processor 404 can execute instructions 410 stored in the memory 408 to perform the operations. The processor 404 can include one processing device or multiple processing devices. Non-limiting examples of the processor 404 include a Field-Programmable Gate Array ("FPGA"), an application-specific integrated circuit ("ASIC"), a microprocessor, etc.

The processor 404 can be communicatively coupled to the memory 408 via the bus 406. The non-volatile memory 408 may include any type of memory device that retains stored information when powered off. Non-limiting examples of the memory 408 include electrically erasable and programmable read-only memory ("EEPROM"), flash memory, or any other type of non-volatile memory. In some examples, at least some of the memory 408 can include a medium from which the processor 404 can read the instructions 410. A computer-readable medium can include electronic, optical, magnetic, or other storage devices capable of providing the processor 404 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The transceiver 118 can include a power source 412. The power source 412 can be in electrical communication with the computing device 402 and the antenna 414. In some examples, the power source 412 can include a battery (e.g. for powering the transceiver 118). In other examples, the transceiver 118 can be coupled to and powered by an electrical cable (e.g., a wireline).

Additionally or alternatively, the power source 412 can include an AC signal generator. The computing device 402 can operate the power source 412 to apply a transmission signal to the antenna 414. For example, the computing device 402 can cause the power source 412 to apply a voltage with a frequency within a specific frequency range to the antenna 414. This can cause the antenna 414 to generate a surface wave, which can be transmitted to another transceiver 118. In other examples, the computing device 402, rather than the power source 412, can apply the transmission signal to the antenna 414.

The transceiver 118 can include a communications interface 416. The communications interface 416 can include or can be coupled to an antenna 414. In some examples, part or all of the communications interface 416 can be implemented in software. For example, the communications interface 416 can include instructions 410 stored in memory 408.

The communications interface 416 can receive data via the antenna 414. For example, the communications interface 416 can detect surface waves via the antenna 414. In some examples, the communications interface 416 can amplify, filter, demodulate, frequency shift, and otherwise manipulate the detected surface waves. The communications interface 416 can transmit a signal associated with the detected surface waves to the processor 404. In some examples, the processor 404 can receive and analyze the signal to retrieve data associated with the detected surface waves.

In some examples, the processor 404 can analyze the data and perform one or more functions. For example, the processor 404 can generate a response based on the data. The processor 404 can cause a response signal associated with the response to be transmitted to the communications interface 416. The communications interface 416 can generate surface waves via the antenna 414 to communicate the response to another transceiver 118 or communications device. In this manner, the processor 404 can receive, analyze, and respond to communications from another transceiver 118.

As discussed above, the communications interface 416 can transmit data via the antenna 414. For example, the communications interface 416 can transmit surface waves that are modulated by data via the antenna 414. In some examples, the communications interface 416 can receive signals (e.g., associated with data to be transmitted) from the processor 404 and amplify, filter, modulate, frequency shift, and otherwise manipulate the signals. The communications interface 416 can transmit the manipulated signals to the antenna 414. The antenna 414 can receive the manipulated signals and responsively generate surface waves that carry the data.

Figure 5:
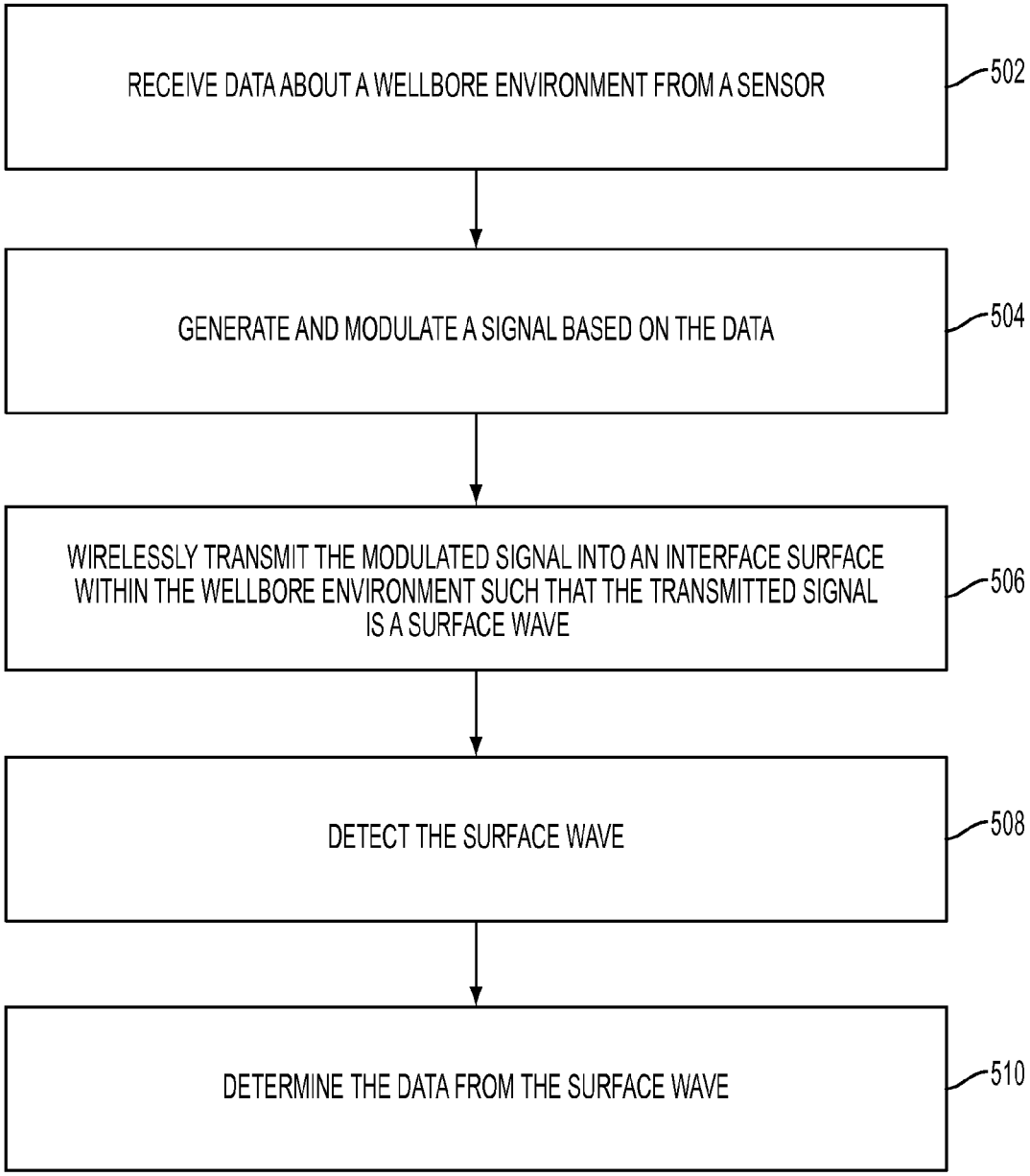
FIG. 5 is a flow chart showing an example of a process for downhole wireless communication using surface waves according to one example.

FIG. 5 is a flow chart showing an example of a process for downhole wireless communication using surface waves according to one example.

In block 502, a transceiver (e.g., a processor coupled to the transceiver) receives data about a wellbore environment from a sensor. For example, the sensor can detect an amount of a fluid in the wellbore. As another example, the sensor can detect a temperature of a location in the wellbore. The sensor can transmit a sensor signal representing the data to the transceiver.

In block 504, the transceiver generates and modulates a signal based on the data. For example, a processor coupled to the transceiver can analyze the data. Based on the data, the processor can generate and modulate the signal (or cause a communications interface to generate and modulate the signal). The transceiver can transmit the modulated signal to an antenna.

In block 506, the transceiver can wirelessly transmit the modulated signal into an interface surface within the wellbore environment such that transmitted signal is a surface wave. For example, an antenna can receive the modulated signal and responsively output a surface wave that propagates along the interface surface. The interface surface can be external to a well tool in a wellbore. For example, the interface surface can be a surface between a casing string and a cement sheath in the wellbore.

In block 508, another transceiver detects the surface wave. For example, the presence of the surface wave can cause the antenna to generate a voltage or a current. The voltage or the current can be transmitted to the transceiver (e.g., to a communications interface or a processor coupled to the transceiver). Based on the amount of voltage or current, the transceiver can detect the surface wave. For example, if the amount of voltage or current exceeds a threshold, the transceiver can determine a surface wave is present.

In block 510, the other transceiver determines the data from the surface wave. For example, the transceiver (e.g., a communications interface or the processor) can demodulate and filter the surface wave to determine the data.

In some aspects, systems and methods for downhole wireless communication using surface waves are provided according to one or more of the following examples:

Example #1

A communication system that is positionable in a wellbore can include a first transceiver for coupling externally to a casing string and for wirelessly transmitting data by generating and modulating a surface wave that propagates along an interface surface. The surface wave can include an electromagnetic wave that includes a magnetic field or an electric field that is at an acute angle to a direction of propagation of the surface wave. The communication system can also include a second transceiver for coupling to the casing string and for wirelessly receiving the surface wave and detecting the data.

Example #2

The communication system of Example #1 may feature the interface surface being between the casing string and a cement sheath.

Example #3

The communication system of any of Examples #1-2 may feature the first transceiver being electrically coupled to a sensor for receiving a sensor signal from the sensor and modulating the surface wave based on the sensor signal. The sensor can include a pressure sensor, a temperature sensor, a microphone, a resistivity sensor, a vibration sensor, or a fluid flow sensor.

Example #4

The communication system of any of Examples #1-3 may feature the first transceiver including a processing device and a memory device. The memory device can store instructions executable by the processing device for causing the processing device to: receive a sensor signal from a sensor; generate a transmission signal based on the sensor signal; and transmit the transmission signal to an antenna to generate the surface wave. The surface wave can be representative of the data.

Example #5

The communication system of any of Examples #1-4 may feature the second transceiver being positioned externally to the casing string.

Example #6

The communication system of any of Examples #1-5 may feature the first transceiver being operable to generate the surface wave by transmitting a signal with a frequency between 1 kHz and 1 MHz to an antenna.

Example #7

The communication system of any of Examples #1-6 may feature the antenna including a solenoid antenna, a toroid antenna, an electric dipole antenna, or a magnetic dipole antenna.

Example #8

The communication system of any of Examples #1-7 may feature the antenna being positioned coaxially around an outer housing of the casing string.

Example #9

A system can include a first transceiver positioned externally to a casing string for transmitting surface waves in a wellbore to wirelessly communicate data. The surface waves can each comprise a magnetic field or an electric field that is at an acute angle to a direction of propagation of the surface waves. The system can also include a second transceiver coupled to the casing string for receiving the data from the surface waves and for transmitting second surface waves in the wellbore to wirelessly communicate the data. The system can further include a third transceiver coupled to the casing string for receiving the data from the second surface waves and for transmitting the data to a surface of the wellbore.

Example #10

The system of Example #9 may feature the surface waves and the second surface waves propagating along an interface surface between the casing string and a cement sheath.

Example #11

The system of any of Examples #9-10 may feature the first transceiver being electrically coupled to a sensor for receiving a sensor signal from the sensor and modulating the surface waves based on the sensor signal. The sensor can include a pressure sensor, a temperature sensor, a microphone, a resistivity sensor, a vibration sensor, or a fluid flow sensor.

Example #12

The system of any of Examples #9-11 may feature the first transceiver including a processing device and a memory device. The memory device can store instructions executable by the processing device for causing the processing device to: receive a sensor signal from a sensor; generate a transmission signal based on the sensor signal; and transmit the transmission signal to an antenna to generate the surface waves. The surface waves can be representative of the data.

Example #13

The system of any of Examples #9-12 may feature the second transceiver being positioned externally to the casing string and the third transceiver being positioned externally to the casing string.

Example #14

The system of any of Examples #9-13 may feature the first transceiver being operable to generate the surface wave by transmitting a signal with a frequency between 1 kHz and 1 MHz to an antenna.

Example #15

The system of any of Examples #9-14 may feature the antenna including a solenoid antenna, a toroid antenna, an electric dipole antenna, or a magnetic dipole antenna.

Example #16

The system of any of Examples #9-15 may feature the antenna being positioned coaxially around an outer housing of the casing string.

Example #17

A method can include generating and modulating, by a transceiver positioned externally to a casing string, a signal based on data about a wellbore environment. The method can also include wirelessly transmitting, by the transceiver, a modulated signal into an interface surface within the wellbore environment such that the modulated signal is a surface wave. The surface wave can include an electromagnetic wave that includes a magnetic field or an electric field that is at an acute angle to a direction of propagation of the surface wave.

Example #18

The method of Example #17 may feature receiving, by the transceiver, the data about the wellbore environment from a sensor.

Example #19

The method of any of Examples #17-18 may feature detecting, by a second transceiver, the surface wave; and determining, by the second transceiver, the data based on the surface wave.

Example #20

The method of any of Examples #17-19 may feature the interface surface being between the casing string and a cement sheath.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A communication system that is positionable in a wellbore, the communication system comprising:

a first transceiver configured to be coupled externally to a casing string for wirelessly transmitting data by generating and modulating a surface wave that propagates along an interface surface between the casing string and a cement sheath, wherein the surface wave comprises an electromagnetic wave that includes a magnetic field or an electric field that is at an acute angle to a direction of propagation of the surface wave along the interface surface; and a second transceiver configured to be coupled to the casing string for wirelessly receiving the surface wave and detecting the data.

2. The communication system of claim 1, wherein the first transceiver is electrically coupled to a sensor comprising a pressure sensor, a temperature sensor, a microphone, a resistivity sensor, a vibration sensor, or a fluid flow sensor for receiving a sensor signal from the sensor and modulating the surface wave based on the sensor signal.

3. The communication system of claim 2, wherein the first transceiver comprises:

a processing device; and a memory device in which instructions executable by the processing device are stored for causing the processing device to:

receive the sensor signal from the sensor;

generate a transmission signal based on the sensor signal; and transmit the transmission signal to an antenna to generate the surface wave, wherein the surface wave is representative of the data.

4. The communication system of claim 1, wherein the second transceiver is positioned externally to the casing string.

5. The communication system of claim 1, wherein the first transceiver is operable to generate the surface wave by transmitting a signal with a frequency between 1 kHz and 1 MHz to an antenna.

6. The communication system of claim 5, wherein the antenna comprises a solenoid antenna, a toroid antenna, an electric dipole antenna, or a magnetic dipole antenna.

7. The communication system of claim 6, wherein the antenna is positioned coaxially around an outer housing of the casing string.

8. The communication system of claim 1, wherein the interface surface is where the casing string meets the cement sheath.

9. A system comprising:

a first transceiver positioned externally to a casing string for transmitting surface waves along an interface surface between the casing string and a cement sheath in a wellbore in order to wirelessly communicate data, wherein the surface waves each comprise a magnetic field or an electric field that is at an acute angle to a direction of propagation of the surface waves along the interface surface;

a second transceiver coupled to the casing string for receiving the data from the surface waves and for transmitting second surface waves in the wellbore to wirelessly communicate the data; and a third transceiver coupled to the casing string for receiving the data from the second surface waves and for transmitting the data to a surface of the wellbore.

10. The system of claim 9, wherein the first transceiver is electrically coupled to a sensor comprising a pressure sensor, a temperature sensor, a microphone, a resistivity sensor, a vibration sensor, or a fluid flow sensor for receiving a sensor signal from the sensor and modulating the surface waves based on the sensor signal.

11. The system of claim 10, wherein the first transceiver comprises:

a processing device; and a memory device in which instructions executable by the processing device are stored for causing the processing device to:

receive the sensor signal from the sensor;

generate a transmission signal based on the sensor signal; and transmit the transmission signal to an antenna to generate the surface waves, wherein the surface waves are representative of the data.

12. The system of claim 9, wherein the second transceiver is positioned externally to the casing string and the third transceiver is positioned externally to the casing string.

13. The system of claim 9, wherein the first transceiver is operable to generate the surface waves by transmitting signals with frequencies between 1 kHz and 1 MHz to an antenna.

14. The system of claim 13, wherein the antenna comprises a solenoid antenna, a toroid antenna, an electric dipole antenna, or a magnetic dipole antenna.

15. The system of claim 14, wherein the antenna is positioned coaxially around an outer housing of the casing string.

16. The system of claim 9, wherein the interface surface is where the casing string meets the cement sheath.

17. A method comprising:

generating and modulating, by a first transceiver positioned externally to a casing string, a signal based on data about a wellbore environment; and wirelessly transmitting, by the first transceiver, the modulated signal into an interface surface between the casing string and a cement sheath within the wellbore environment such that the modulated signal is a surface wave, wherein the surface wave comprises an electromagnetic wave that includes a magnetic field or an electric field that is at an acute angle to a direction of propagation of the surface wave along the interface surface; and wirelessly receiving, by a second transceiver, the surface wave transmitted by the first transceiver.

18. The method of claim 17, further comprising:

receiving, by the first transceiver, the data about the wellbore environment from a sensor.

19. The method of claim 17, further comprising:

determining, by the second transceiver, the data based on the received surface wave.

20. The method of claim 17, wherein the interface surface is where the casing string meets the cement sheath.

* * * * *